US012656074B1

(12) United States Patent
Manghirmalani

(10) Patent No.: US 12,656,074 B1
(45) Date of Patent: Jun. 16, 2026

(54) FIREARM SUPPRESSOR MOUNT

(71) Applicant: Akshay Ramesh Manghirmalani, Midlothian, TX (US)

(72) Inventor: Akshay Ramesh Manghirmalani, Midlothian, TX (US)

( * ) Notice: Subject to any disclaimer, the term of this patent is extended or adjusted under 35 U.S.C. 154(b) by 0 days.

(21) Appl. No.: 18/608,123

(22) Filed: Mar. 18, 2024

(51) Int. Cl.
*F41A 21/30* (2006.01)

(52) U.S. Cl.
CPC ..... *F41A 21/30* (2013.01)

(58) Field of Classification Search
CPC ..... F41A 21/325
See application file for complete search history.

(56) References Cited

U.S. PATENT DOCUMENTS 4,893,426 A * 1/1990 Bixler ..... F16B 7/20 89/14.05
5,559,302 A * 9/1996 Latka ..... F41A 21/325 89/14.05
5,685,102 A * 11/1997 Latka ..... F41A 21/325 89/14.05
5,773,746 A * 6/1998 Vaden ..... F41A 21/325 89/14.4
5,882,044 A * 3/1999 Sloane ..... F16L 19/005 285/321
6,385,891 B1 * 5/2002 Rabatin ..... F41A 21/325 42/79
7,059,235 B2 * 6/2006 Hanslick ..... F41A 21/38 89/14.3
7,156,424 B2 * 1/2007 McCord ..... F16L 19/005 411/329
7,610,710 B2 * 11/2009 Brittingham ..... F41A 21/325 89/14.4
7,743,693 B1 * 6/2010 Brittingham ..... F41A 21/325 89/14.4
7,891,282 B1 * 2/2011 DeGroat ..... F41A 21/325 89/14.4
8,091,462 B2 * 1/2012 Dueck ..... F41A 21/26 42/76.01
D666,883 S 9/2012 Howard et al.
(Continued)

OTHER PUBLICATIONS

Revival Defense, "Forward Controls Design JCW (Joint Castle Nut Wrench)," retrieved on 2024-03-18 from: https://www.revivaldefense.com/forward-controls-design-jcw-joint-castle-nut-wrench; publication date unknown; 3 pp.
(Continued)

*Primary Examiner* — Derrick R Morgan
(74) *Attorney, Agent, or Firm* — Law Office of Sam Sokhansanj PLLC

(57) ABSTRACT

A firearm suppressor mount is disclosed having a first region with a plurality of notches, a second region having a protruding ring, and a third region having a male threaded component, wherein the male threaded component is adapted to engage a firearm suppressor. Here, the first region or second region can further include a female threaded component. Also, the female threaded component can be adapted to engage one or more threads of a muzzle device, flash hider, or muzzle brake. Also, each of the plurality of notches can be configured to Technical Data Specification (TDP). Here, the plurality of notches can be adapted to engage two or more protrusions of a torque wrench.

17 Claims, 7 Drawing Sheets

(56) References Cited

U.S. PATENT DOCUMENTS 8,272,306 B1 * 9/2012 Smith ..... F41A 21/30 89/14.4
8,555,765 B2 * 10/2013 Graham ..... F41A 21/325 89/14.3
9,261,319 B1 * 2/2016 Palu ..... F41A 21/34
9,513,078 B1 * 12/2016 Fulton ..... F41A 21/325
9,541,344 B2 * 1/2017 Moon ..... F41A 21/36
9,631,888 B2 * 4/2017 Young ..... F41A 21/325
9,658,019 B2 * 5/2017 Smith ..... F41A 21/30
9,739,560 B1 * 8/2017 Salvador ..... F41A 21/34
9,921,021 B1 * 3/2018 Graham, II ..... F41A 21/325
9,927,201 B2 * 3/2018 Penchuk ..... F41A 21/325
10,054,382 B2 * 8/2018 Palu ..... F41A 21/30
10,119,779 B1 * 11/2018 Miele ..... F41A 21/30
10,184,745 B1 * 1/2019 Fulton ..... F41A 21/30
10,281,228 B1 * 5/2019 Marfione ..... F41A 21/30
10,480,884 B2 * 11/2019 Smith ..... F41A 21/30
10,480,888 B2 * 11/2019 Barrett ..... F41A 21/28
D886,229 S * 6/2020 McDonald ..... D22/108
10,794,651 B2 * 10/2020 Crown ..... F41A 21/30
10,801,796 B2 * 10/2020 Kras ..... F41A 21/325
10,852,091 B1 * 12/2020 Helms ..... F41A 21/30
10,883,788 B2 * 1/2021 Marcotte ..... F41A 21/482
11,243,040 B2 * 2/2022 Honigmann ..... F41A 21/26
11,326,849 B2 * 5/2022 Edminster ..... F41A 21/30
11,408,702 B2 * 8/2022 Reis-Green ..... F41A 21/325
11,530,891 B2 * 12/2022 Quinn ..... F41A 21/36
11,614,299 B1 * 3/2023 Oglesby ..... F41A 5/26 89/193
11,732,989 B2 * 8/2023 Kras ..... F41A 21/325 89/14.4
11,761,725 B1 * 9/2023 Sanders ..... F41A 21/36 89/14.3
12,055,356 B2 * 8/2024 Reel ..... F41A 21/34
D1,057,070 S * 1/2025 Bundy ..... D22/108
2007/0095198 A1 * 5/2007 Dater ..... F41A 21/325 89/14.3
2008/0156183 A1 * 7/2008 Brittingham ..... F41A 21/30 89/14.4
2010/0229712 A1 * 9/2010 Graham ..... F41A 21/34 42/76.01
2010/0313743 A1 * 12/2010 Dueck ..... F41A 21/325 89/14.05
2011/0036233 A1 * 2/2011 DeGroat ..... F41A 21/325 89/14.4
2011/0088540 A1 * 4/2011 Brittingham ..... F41A 21/26 89/14.5
2011/0154711 A1 * 6/2011 Dickerson ..... F41A 21/325 42/107
2013/0000170 A1 * 1/2013 Dueck ..... F41A 21/26 42/70.01
2013/0180150 A1 * 7/2013 Dueck ..... F41A 21/34 29/428
2014/0231168 A1 * 8/2014 Dueck ..... F41A 21/325 181/223
2015/0135575 A1 * 5/2015 Wood, Jr. ..... F41A 21/325 42/90
2016/0084602 A1 * 3/2016 Smith ..... F41A 21/325 89/14.05
2016/0102935 A1 * 4/2016 Young ..... F41A 21/325 42/76.01
2016/0109205 A1 * 4/2016 Coppinger ..... F41A 21/30 89/14.4
2016/0370141 A1 * 12/2016 Sy ..... F41A 21/325
2017/0184367 A1 * 6/2017 Odle ..... F41A 21/325
2017/0261281 A1 * 9/2017 Salvador ..... F41A 21/325
2017/0321984 A1 * 11/2017 Palu ..... F41A 21/34
2018/0058791 A1 * 3/2018 Larue ..... F41A 21/325
2018/0106569 A1 * 4/2018 Smith ..... F41A 21/30
2018/0299223 A1 * 10/2018 Barrett ..... F41A 21/30
2018/0306544 A1 * 10/2018 White ..... F41A 21/30
2019/0226788 A1 * 7/2019 Johansen ..... F41A 21/325
2019/0285377 A1 9/2019 Jacobson
2020/0370852 A1 * 11/2020 Marcotte ..... F41A 21/482
2021/0172694 A1 * 6/2021 Reel ..... F41A 21/34
2021/0199401 A1 * 7/2021 Magee ..... F41A 21/325
2022/0325972 A1 * 10/2022 Lovas ..... F41A 21/325
2022/0333890 A1 * 10/2022 Griffitts ..... F41A 21/325
2023/0128649 A1 * 4/2023 Lee ..... F41A 21/325 89/14.05
2023/0148295 A1 * 5/2023 Reis-Green ..... F41A 21/325 89/14.05
2023/0228516 A1 * 7/2023 Reis Green ..... F41A 21/325 89/14.05
2023/0288164 A1 * 9/2023 D'Amato ..... F41A 21/30
2023/0341208 A1 * 10/2023 Young ..... F41A 21/30
2024/0003646 A1 * 1/2024 Roberts ..... F41A 21/325
2024/0060742 A1 * 2/2024 DeJessa ..... F41A 21/34
2024/0077273 A1 * 3/2024 Kras ..... F41A 21/325
2024/0288243 A1 * 8/2024 Riley ..... F41A 21/30
2025/0044051 A1 * 2/2025 Hood, II ..... F41A 21/30
2025/0137745 A1 * 5/2025 Magee ..... F41A 21/30

OTHER PUBLICATIONS

Magpul, "Magpul® Armorer's Wrench—AR15/M4," retrieved on Mar. 18, 2024 from: https://magpul.com/magpul-armorers-wrench-ar15-m4.html?mp_global_color=118; publication date unknown; 4 pp.

Real Avid, "Armorer's Master Wrench®," retrieved on Mar. 18, 2024 from: https://www.realavid.com/product/armorers-master-wrench/; publication date unknown; 7 pp.

Midwest Industries Inc., "Professional Armorer's Wrench," retrieved on Mar. 18, 2024 from: https://midwestindustriesinc.com/professional-armorers-wrench/; publication date unknown; 4 pp.

* cited by examiner

FIREARM SUPPRESSOR MOUNT

BACKGROUND

This section is intended to introduce the reader to aspects of art that may be related to various aspects of the present disclosure described herein, which are described and/or claimed below. This discussion is believed to be helpful in providing the reader with background information to facilitate a better understanding of the various aspects of the present disclosure described herein. Accordingly, it should be understood that these statements are to be read in this light, and not as admissions of prior art.

Generally, silencers or suppressors are sold either with a fixed "direct thread mount," a proprietary "Quick Detach" system, or are threaded in a universal thread pitch, commonly in 1.375×24 TPI. There are generally two common methods of securing a suppressor or silencer to a firearm, such as a handgun, semi-automatic rifle (e.g., AR-15), or automatic rifle. The first method can include a direct attachment by directly securing a female threaded end of the suppressor to a male threaded end of a barrel/muzzle of the firearm. For the foregoing first method, the threads (and pitch of the threads) of the female end of the suppressor need to be compatible or match the threaded male end of the barrel, thereby allowing a secure fitment. The second method can include using a silencer mount compatible muzzle device (which can also be referred to as a "flash hider" or "muzzle brake"), or a quick detachment device. The muzzle mount device includes threads on a female end (or a male end) or outer surface that threads directly onto the threaded male end (or threaded female end) of a barrel. The muzzle mount may be secured to the end of the barrel via other means, such as via welding, among others.

However, conventional silencer mounts typically only work with spanner wrenches or other means of installation that typically do not hold a tight tolerance which can result in inaccurate installation and fitment of the mount and silencer on the muzzle (without proper torquing) and cause decoupling of the silencer from the muzzle, thereby damaging the silencer and the firearm.

Hence, what is needed is a silencer mount that can work with existing Armorer's wrenches and tools that can allow for proper torquing of the mount on to a suppressor and to the suppressor's torque specifications in order to provide a secure and tight fitment of the mount on the suppressor and prevent inadvertent decoupling of the suppressor from the muzzle of the firearm.

BRIEF SUMMARY

A silencer or suppressor mount is disclosed having castle nut style notches that allow the silencer mount to work with existing Armorer's torque wrenches and tools in order to properly torque the mount on to a suppressor to the suppressor (or the mount's) torque specifications in order to provide a secure and tight fitment of the mount on to the suppressor and prevent in advertent decoupling of the suppressor from the muzzle of the firearm, and preventing damage to the suppressor or firearm, among other advantages.

In one non-limiting exemplary embodiment of the disclosure described herein, a firearm suppressor mount is disclosed having a first region with a plurality of notches, a second region having a protruding ring, and a third region having a male threaded component, wherein the male threaded component is adapted to engage a firearm suppressor. Here, the first region or second region can further include a female threaded component. Also, the female threaded component can be adapted to engage one or more threads of a muzzle device, flash hider, or muzzle brake. Also, each of the plurality of notches can be configured to Technical Data Specification (TDP). Here, the plurality of notches can be adapted to engage two or more protrusions of a torque wrench. In addition, each of the plurality of notches can be separated by a raised protrusion having a flat top surface. Moreover, each raised protrusion may include a cut-out region on its side. Further, wherein each of the plurality of notches can include a width of about 0.0160 in. In addition, each of the plurality of notches can include a depth of about 0.125 in. Also, the protruding ring may include a sloped top surface.

In another non-limiting exemplary embodiment of the disclosure described herein, a firearm suppressor mount is disclosed having a plurality of notches, a protruding ring disposed below the plurality of notches, and a male threaded component disposed below the protruding ring. Here, the male threaded component can be adapted to engage one or more threads of a firearm suppressor. Also, the male threaded component can include a thread pitch of 1.375×24 TPI or 1.375"×24. The suppressor mount can also include a female threaded component, wherein the female threaded component can be adapted to engage one or more threads of a muzzle device, flash hider, or muzzle brake. In addition, the suppressor mount can include a sloped or tapered radial protrusion disposed above or below the female threaded component. Further, each of the plurality of notches can be separated by a raised arcuate wall, wherein the wall can include a flat top surface. Also, the raised arcuate wall comprises a cut-out region, wherein the cut-out region is adapted to engage a wrench or plier. Further, the raised arcuate wall can also include beveled or rounded edges.

The above summary is not intended to describe each and every disclosed embodiment or every implementation of the disclosure. The Description that follows more particularly exemplifies the various illustrative embodiments.

BRIEF DESCRIPTION OF THE DRAWINGS

The following description should be read with reference to the drawings, in which like elements in different drawings are numbered in like fashion. The drawings, which are not necessarily to scale, depict selected embodiments and are not intended to limit the scope of the disclosure. The disclosure may be more completely understood in consideration of the following detailed description of various embodiments in connection with the accompanying drawings, in which.

DETAILED DESCRIPTION

In the Brief Summary of the present disclosure above and in the Detailed Description of the disclosure described herein, and the claims below, and in the accompanying drawings, reference is made to particular features (including method steps) of the disclosure described herein. It is to be understood that the disclosure of the disclosure described herein in this specification includes all possible combinations of such particular features. For example, where a particular feature is disclosed in the context of a particular aspect or embodiment of the disclosure described herein, or a particular claim, that feature can also be used, to the extent possible, in combination with and/or in the context of other particular aspects and embodiments of the disclosure described herein, and in the disclosure described herein generally.

The embodiments set forth below represent the necessary information to enable those skilled in the art to practice the disclosure described herein and illustrate the best mode of practicing the disclosure described herein. In addition, the disclosure described herein does not require that all the advantageous features and all the advantages need to be incorporated into every embodiment of the disclosure described herein.

Figure 1:
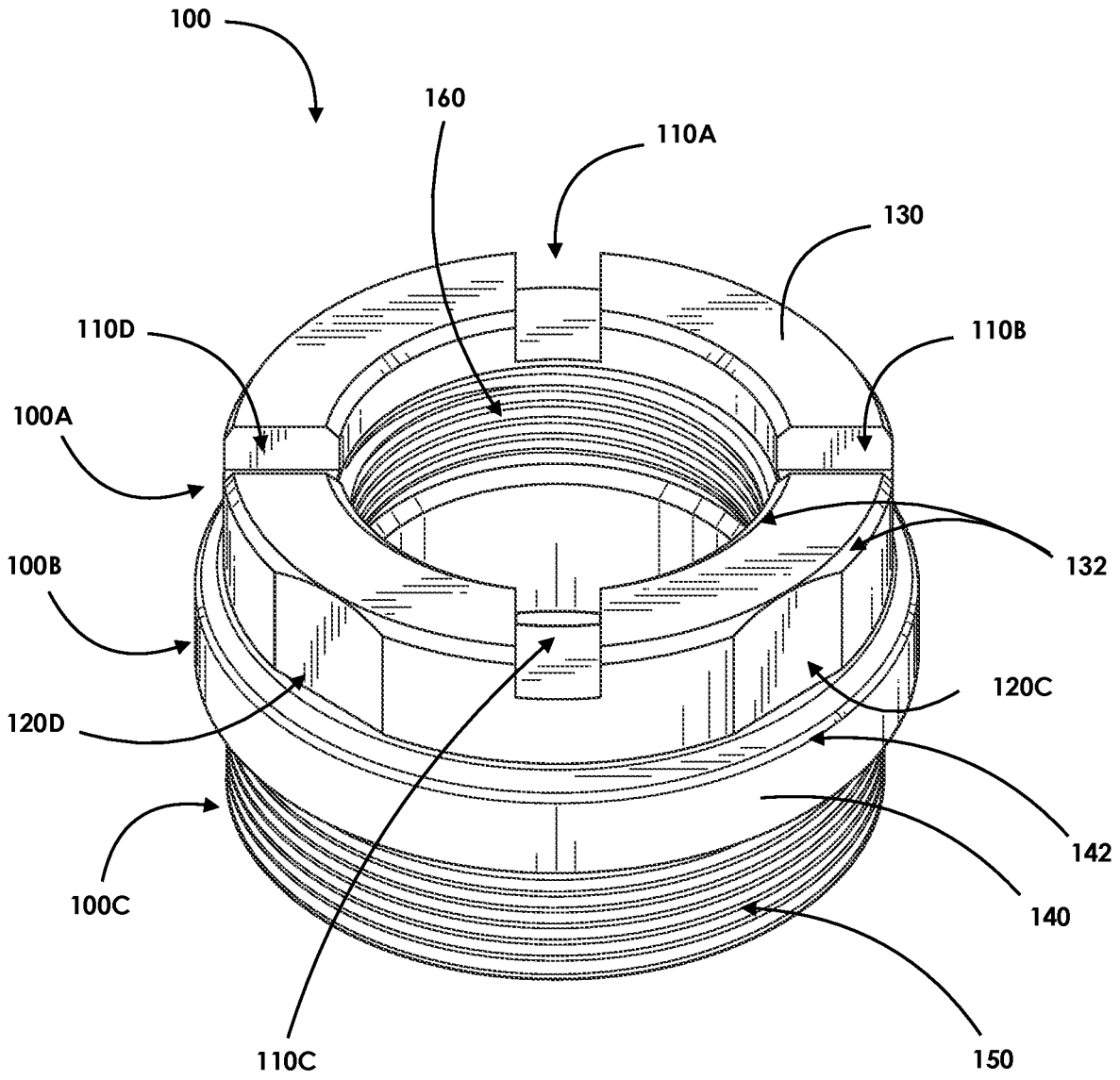
FIG. 1 illustrates a perspective view of the suppressor mount of the disclosure described herein, according to one non-limiting exemplary embodiment.
Figure 2A:
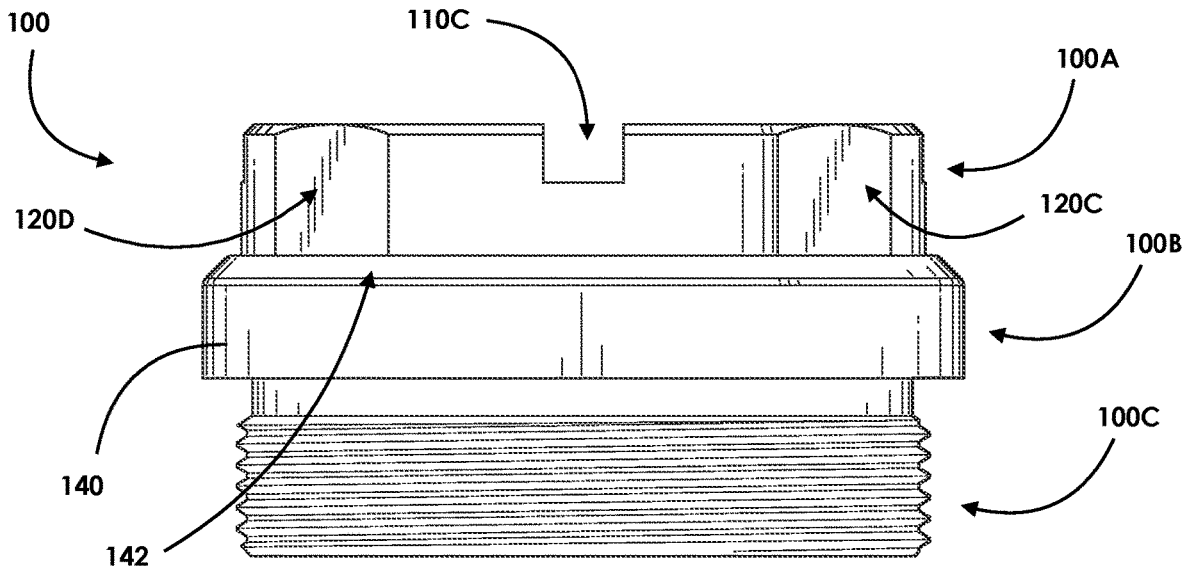
FIG. 2A illustrates a front view of the suppressor mount of FIG. 1.
Figure 2B:
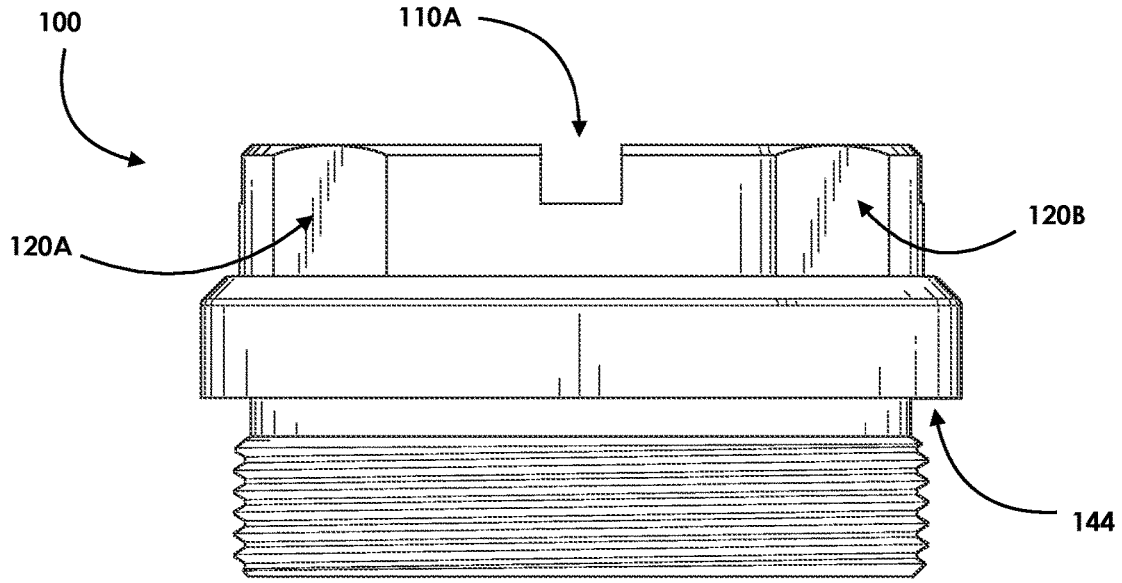
FIG. 2B illustrates a rear view of the suppressor mount of FIG. 1.
Figure 3A:
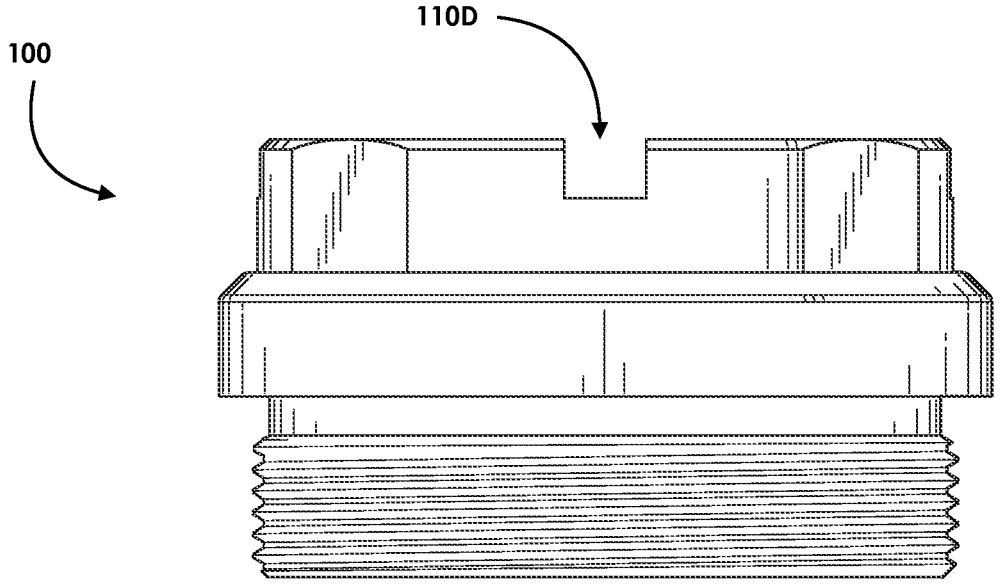
FIG. 3A illustrates a left side view of the suppressor mount of FIG. 1.
Figure 3B:
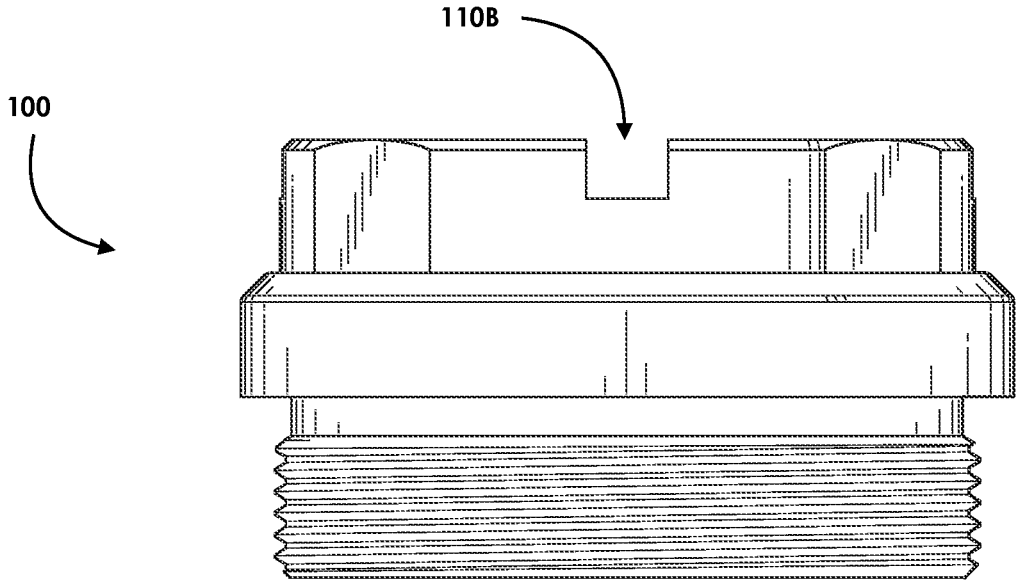
FIG. 3B illustrates a right side view of the suppressor mount of FIG. 1.
Figure 4A:
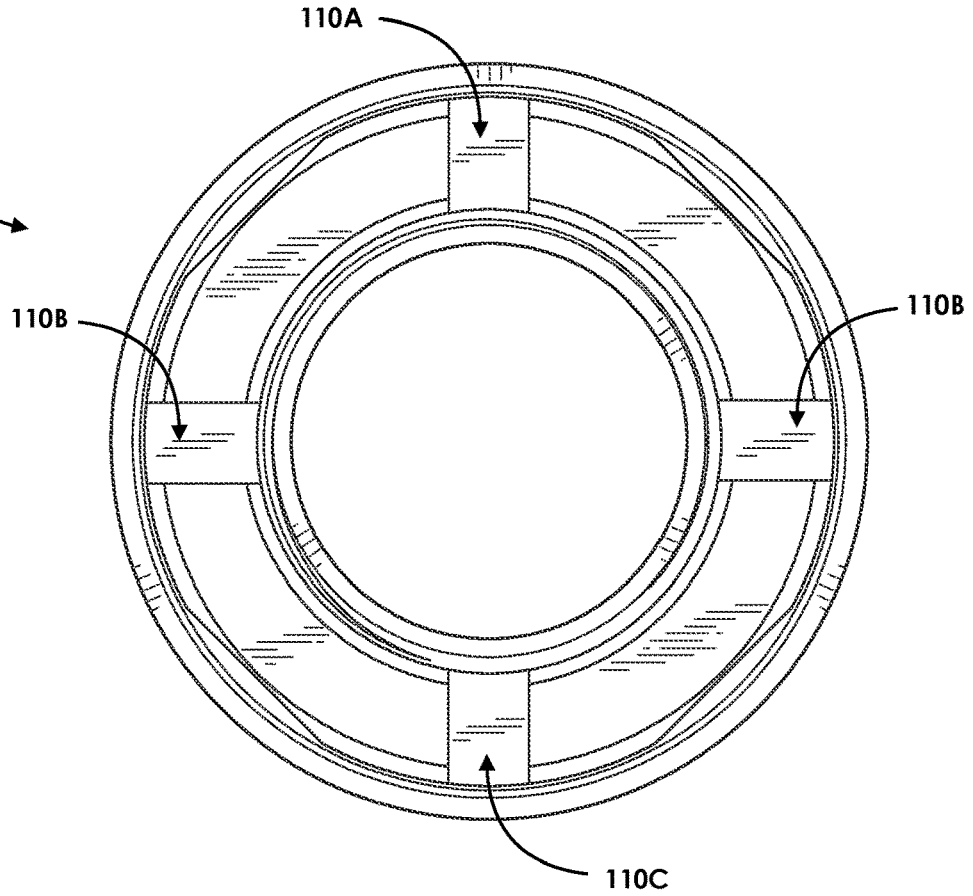
FIG. 4A illustrates a top view of the suppressor mount of FIG. 1.
Figure 4B:
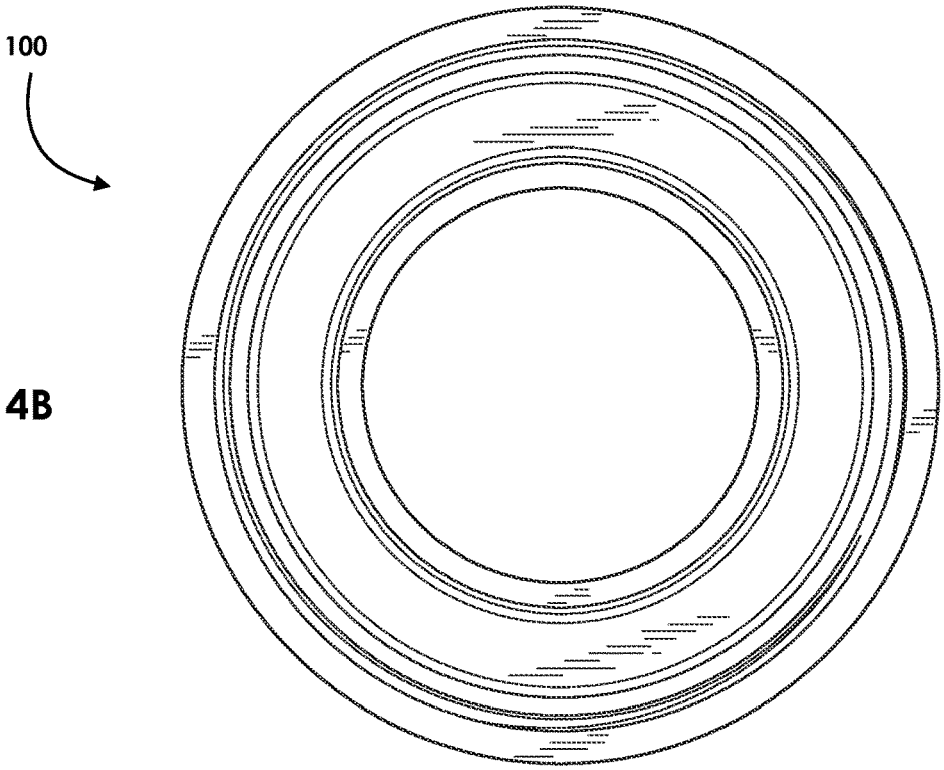
FIG. 4B illustrates a bottom view for the suppressor mount of FIG. 1.
Figure 5:
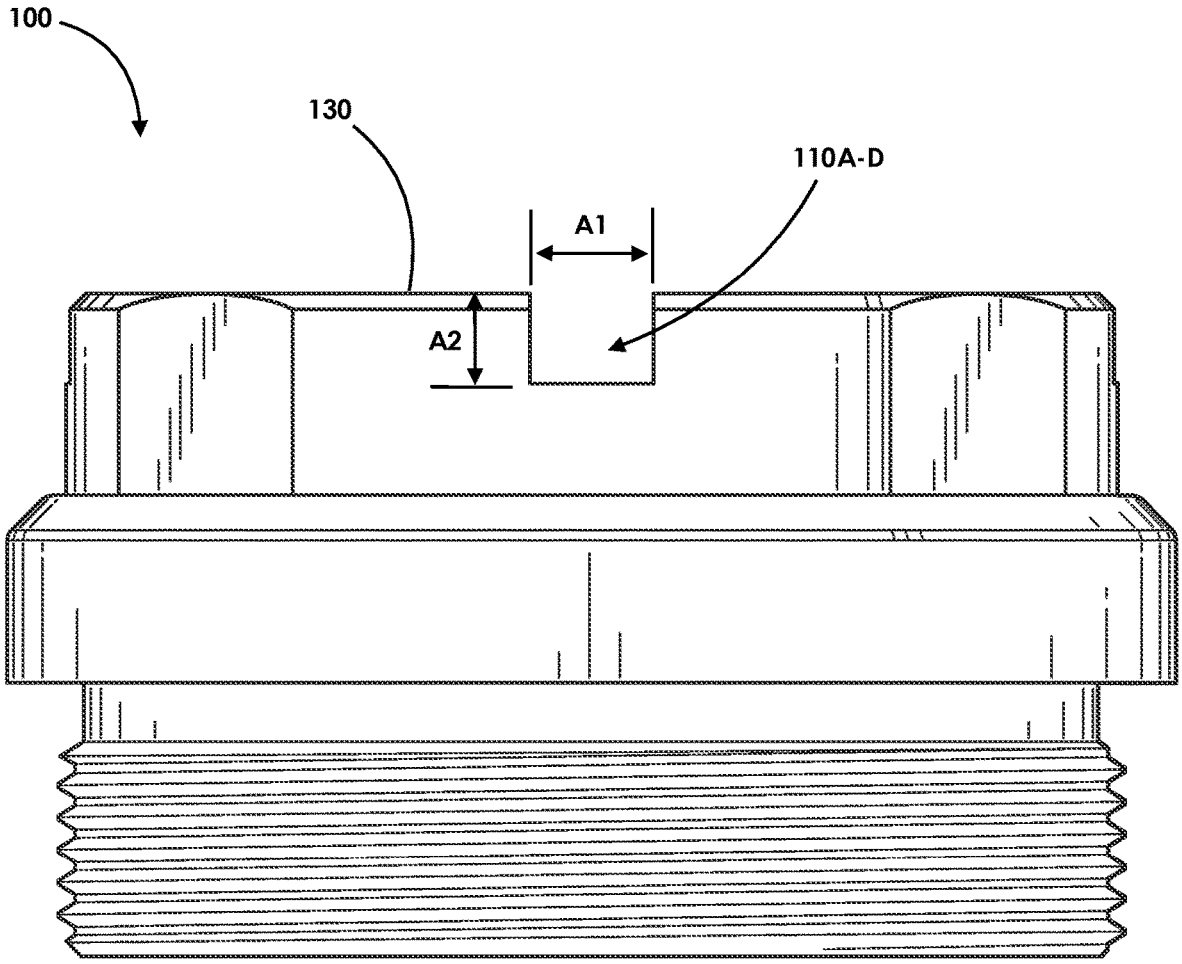
FIG. 5 illustrates an enlarged front view, rear view, or side view of the suppressor mount of FIG. 1.
Figure 6:
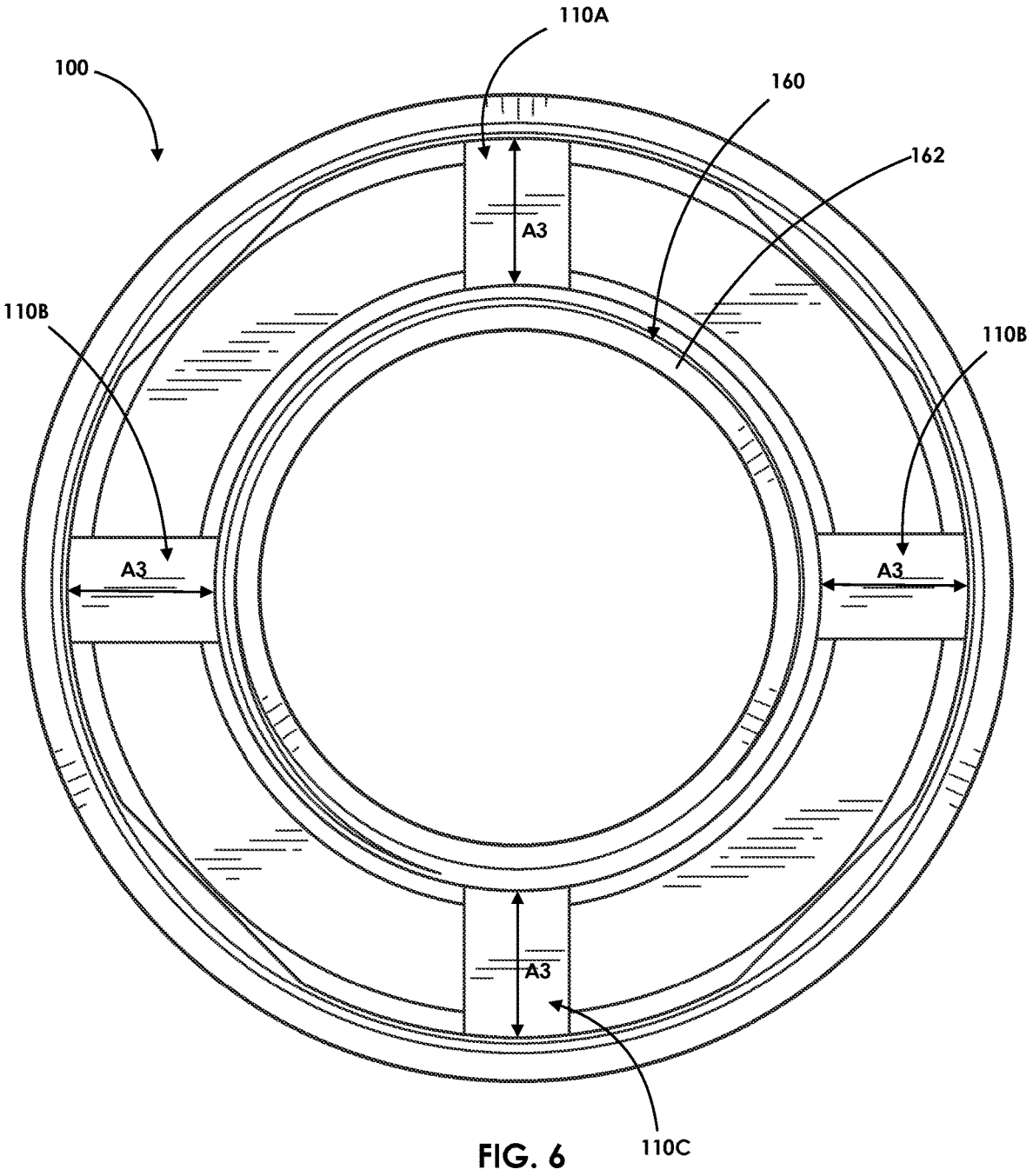
FIG. 6 illustrates an enlarged top view of the suppressor mount of FIG. 1.
Figure 7:
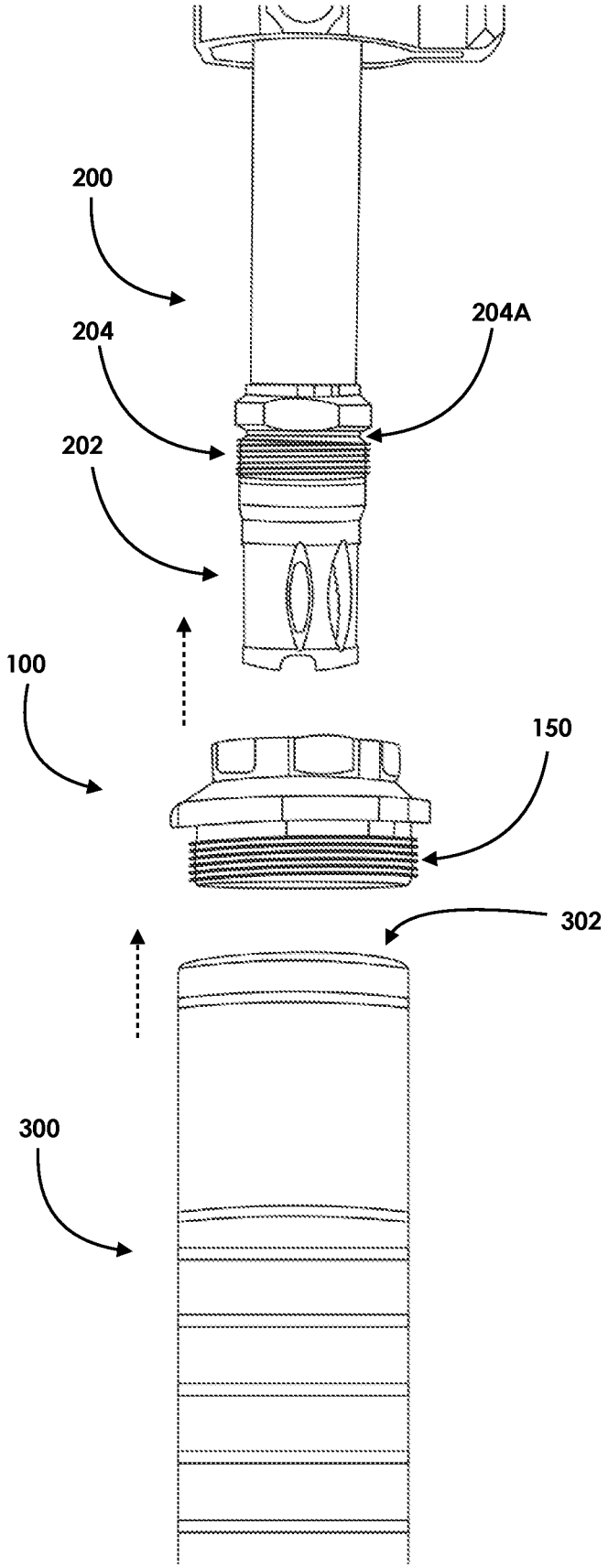
FIG. 7 illustrates a simplified partial perspective side view of the suppressor mount, firearm barrel, and suppressor, and a method of assembly, according to one non-limiting exemplary embodiment.

FIGS. 1-6 illustrate one non-limiting embodiment of the firearm silencer/suppressor adapter or mount 100 of the disclosure described herein having a "castle nut" style configuration. As used herein, a "castle nut" may include any type of nut that is threaded on both of its interior and/or exterior surfaces, a slotted nut, and/or any type of nut having cut-outs, notches, grooves, channels, or openings thereon. Here, suppressor mount 100 is shown having an upper region 100A, a middle region 100B, a lower region 100C. Upper region 100A is shown having at least four (4) cut-out regions, slots, or notches 110A, 110B, 110C, and 110D that are each spaced apart evenly in a radial pattern. However, in other embodiments, mount 100 may include any number of notches. In addition, between each of notches 110A-110D are raised ridge or wall regions 130 in an arcuate configuration having a flat top surface with rounded or beveled edges 132. In addition, upper region 100A further includes at least four flat or slightly arcuate cut-away regions 120A, 120B, 120C, and 120D evenly spaced apart in a radial pattern and disposed between each of notches 110A-110D. Here, regions 120A-120D can be adapted to engage any type of flat head wrench or adjustable open-end wrench or plier, among others. In addition, an interior space of the upper region 100A (and partially middle region 100B) includes a threaded region 160 having a plurality of threads at a thread pitch of 0.900"-24". Further, as shown in FIG. 6, the lower end of the threaded region 160 includes a raised angled, tapered, and sloped lip, shelf, abutment, or stop 162 that prevents and stops further threading of another component (such as muzzle component 202, FIG. 7) within mount 100 as the other component engages stop 162. As shown in FIG. 7, the tapered stop 162 allows for proper securement of component 202 on to the suppressor via mount 100, whereby stop 162 engages and aligns with and presses against the sloped cut-out region 204A of component 202, thereby providing physical feedback to the user as he/she is manually threading and securing the suppressor 300 onto component 202 via mount 100.

Still referring to FIGS. 1-6, middle region 100B includes ring 140 that projects outwards or horizontally away from the top and lower regions of mount 100. In particular, ring 140 can include a rounded, beveled, or sloped top surface 142. In addition, the lower region 100C of mount 100 can include a threaded region 150 having a thread count or thread pitch of 1.375×24 TPI or 1.375 in.×24. However, it is contemplated within the scope of the present disclosure described herein that region 150 may include any thread count, thread pitch, or threads per inch (TPI) and any bolt or nut diameter, such as from 0.1×24 TPI up to and including 2.0×24 TPI, among other variations, TPI's, and nut/bolt diameters that can be compatible with the TPI and nut/bolt diameter of a suppressor or silencer. As shown in FIG. 6, the threaded region 150 allows mount 100 to be quickly threaded thereon (and detached) to a suppressor or silencer 300. Here, the bottom end surface 142 of ring 140 can further operate as a stop for suppressor 300 from being threaded any further onto mount 100, thereby preventing damage to the suppressor or mount 100.

Still referring to FIGS. 1-6, each of notches 110A-110D are adapted to engage and align with two or more protrusions of a specialized torque wrench or Armorer's Wrench, such as the Forward "Controls Design JCW (Joint Castle Nut Wrench)" sold by Revival Defense LLC, which is incorporated herein by reference in its entirety, or the Magpul® "Armorer's Wrench—AR15/M4," which is incorporated herein by reference in its entirety, and any other similar Armorer Wrenches, such as ones made by Midwest Industries, Inc. and Real Avid®, or the "Armorer's tool" of U.S. D666883, which is incorporated herein by reference in its entirety, or the "Armorer's Wrench" of US20190285377A1, which is incorporated herein by reference in its entirety. Specifically, referring to FIGS. 5-6, each of notches 110A-110D can include a width A1 of 0.160 in. or within @ 0_155 in. to $0,165 in. (or about 0.160 in.), a height A2 of 0.125 in. or within 0.120 in. to 1.130 in. (or about 0.125 in.), and a depth A3 of about 0.110 in. or from about 0.05 up to 1.0 in. In particular, the foregoing width A1 and A2 of mount 100 are adapted to specifically engage the protruding members of the aforementioned torque wrenches such that there is little to minimal movement (or "wiggle") of the protruding members as they are engaged with the each of notches 110A-110D thereby allow allowing precise or near-precise control of mount 100. Here, mount 100 of the disclosure described herein was shown through testing to provide consistent and repeatable accurate torque measurements, relative to conventional firearm silencer mounts or adapters. In addition, the notches 110A-110D of mount 100 are sized and configured in accordance to "TDP Spec" or "Technical Data Package."

FIG. 6 illustrates one non-limiting exemplary embodiment of a method of installing and securing mount 100 of the disclosure described herein on to a firearm muzzle/barrel 200 and suppressor 300. In particular, the firearm muzzle/barrel 200 may include a mounting component or muzzle device 202 such as a flash hider or muzzle brake having a threaded outer region 204 adapted to engage the threaded interior region 160 of mount 100. Specifically, it is at this stage that mount 100 is torqued to specification on a suppressor at about 25 ft/lbs up to and including 30 ft/lbs. (or any desired specification or setting) via the aforementioned torque wrenches engaging two or more of notches 110A-110D of mount 100. In particular, any type of suppressor or silencer 300 having a compatible 1.375 in.×24 threaded hub therein can engage the threads 150 of mount 100 and be further torqued to specification via the aforementioned torque wrenches, such an Armorer's Wrench, thereby providing a proper, tight, and secure fitment of the mount 100 onto the suppressor. Next, as shown in FIG. 7, the threads 160 of mount 100 can further engage threads 204 of mount 202 thereby allowing quick attachment of the suppressor (via mount 100) on to component 202, via hand or manual operation without the use of additional tools, and be further quickly removed or detached from component 202, among other advantages.

It is contemplated within the scope of the disclosure described herein mount 100 can be made of any material, including but not limited to any type of metal, alloy mixture, stainless steel, titanium, cobalt, aluminum, or the like. In addition, mount 100 of the disclosure described herein is adapted to work on and be compatible with any type of firearm, such as handguns, shotguns, rifles, automatic rifles, semi-automatic rifles, and AR-15 style rifles, among others, From the foregoing it will be seen that the present disclosure described herein is one well adapted to attain all ends and objectives herein-above set forth, together with the other advantages which are obvious and which are inherent to the invention.

Since many possible embodiments may be made of the invention without departing from the scope thereof, it is to be understood that all matters herein set forth or shown in the accompanying drawings are to be interpreted as illustrative, and not in a limiting sense.

While specific embodiments have been shown and discussed, various modifications may of course be made, and the invention is not limited to the specific forms or arrangement of parts described herein, except insofar as such limitations are included in following claims. Further, it will be understood that certain features and sub-combinations are of utility and may be employed without reference to other features and sub-combinations. This is contemplated by and is within the scope of the claims.

What is claimed is:

1. A unibody firearm suppressor mount, comprising:

a first region of the unibody firearm suppressor mount comprising a first ring having a plurality of notches in a radial configuration, wherein each of the plurality of notches comprise a width of about 0.160 in., wherein each of the plurality of notches comprise two opposing surfaces that are parallel with respect to each other;

a second region of the unibody firearm suppressor mount comprising a second ring disposed below the first ring of the first region, and wherein the second ring is larger in diameter relative to the first ring of the first region; and a third region of the unibody firearm suppressor mount comprising a third ring disposed below the second ring of the second region, wherein the third ring is smaller in diameter than the second ring of the second region, wherein the third ring comprises a male threaded component, and wherein the male threaded component is adapted to engage a firearm suppressor.

2. The firearm suppressor mount of claim 1, wherein the first region or second region further comprises a female threaded component.

3. The firearm suppressor mount of claim 2, wherein the female threaded component is adapted to engage one or more threads of a muzzle device, flash hider, or muzzle brake.

4. The firearm suppressor mount of claim 1, wherein the plurality of notches are adapted to engage two or more protrusions of a torque wrench.

5. The firearm suppressor mount of claim 1, wherein each of the plurality of notches are separated by a raised protrusion having a flat top surface.

6. The firearm suppressor mount of claim 5, wherein a side of each raised protrusion comprises a cut-out region.

7. The firearm suppressor mount of claim 1, wherein each of the plurality of notches comprise a height of about 0.125 in.

8. The firearm suppressor mount of claim 1, wherein the protruding ring comprises a sloped top surface.

9. A unibody firearm suppressor mount, comprising:

a plurality of notches equally spaced apart from each other and disposed in a radial configuration, each of the plurality of notches comprising a bottom flat surface, a first flat side wall, and a second flat side wall, wherein a width of the bottom flat surface is larger than a height of the first or second flat side wall, and wherein the first flat side wall and the second flat side wall are parallel with respect to each other;

a plurality of arched cut-outs, wherein each of the arched cut-outs are disposed between each of the plurality of notches;

a protruding ring disposed below the plurality of notches; and a male threaded component disposed below the protruding ring.

10. The firearm suppressor mount of claim 9, wherein the male threaded component is adapted to engage one or more threads of a firearm suppressor.

11. The firearm suppressor mount of claim 9, wherein the male threaded component comprises a thread pitch of 1.375×24 threads per inch (TPI).

12. The firearm suppressor mount of claim 9, further comprises a female threaded component, wherein the female threaded component is adapted to engage one or more threads of a muzzle device, flash hider, or muzzle brake.

13. The firearm suppressor mount of claim 12, further comprises a sloped or tapered radial protrusion disposed above or below the female threaded component.

14. The firearm suppressor mount of claim 9, wherein each of the plurality of notches are separated by a raised arcuate wall, wherein the wall comprises a flat top surface.

15. The firearm suppressor mount of claim 14, wherein the raised arcuate wall comprises a cut-out region, wherein the cut-out region is adapted to engage a wrench or plier.

16. The firearm suppressor mount of claim 14, wherein the raised arcuate wall further comprises beveled or rounded edges.

17. A unibody firearm suppressor mount, comprising:

a first round region comprising a plurality of notches in a radial configuration, wherein each of the plurality of notches comprise a width in a range of 0.155 in. to 0.165 in., wherein each of the plurality of notches comprise two opposing surfaces that are parallel with respect to each other, and wherein each of the plurality of notches are each separated by an arched member having a flat top surface;

an arched cut-out surface disposed around a middle region of the arched member and perpendicular to the flat top surface of the arched member;

a second region comprising a protruding ring; and a third region comprising a male threaded component, wherein the male threaded component is adapted to engage a firearm suppressor.

* * * * *